United States Patent [19]

Schröder et al.

[11] Patent Number: 4,609,345

[45] Date of Patent: Sep. 2, 1986

[54] TUNNEL KILN

[75] Inventors: Paul Schröder; Klaus J. Schröder, both of Höhr-Grenzhausen; Herrmann Kremheller, Nuremberg, all of Fed. Rep. of Germany

[73] Assignee: Ludwig Riedhammer GmbH, Fed. Rep. of Germany

[21] Appl. No.: 741,457

[22] Filed: Jun. 5, 1985

[30] Foreign Application Priority Data

Jun. 8, 1984 [DE] Fed. Rep. of Germany ..... 3421365

[51] Int. Cl.[4] ..... F27B 9/26; F27D 21/00; F27D 3/00

[52] U.S. Cl. ..... 432/137; 432/32; 432/239

[58] Field of Search ..... 432/241, 137, 121, 239, 432/45, 34, 32

[56] References Cited

U.S. PATENT DOCUMENTS 1,851,717 3/1932 Meehan ..... 432/137

FOREIGN PATENT DOCUMENTS 20041 of 1911 United Kingdom ..... 432/137

*Primary Examiner*—John J. Camby

*Attorney, Agent, or Firm*—John F. A. Earley; Frank A. Follmer

[57] ABSTRACT

A tunnel kiln particularly adapted for firing ceramic workpieces has a firing channel including a heating zone, a firing zone, and a cooling zone, and has kiln cars and kiln sole sections which bear the workpieces to be treated and are movable through said firing channel. The kiln sole sections are separated from the kiln cars, and the kiln cars are constructed and arranged to be movable independently of the kiln sole sections.

13 Claims, 4 Drawing Figures

TUNNEL KILN

BACKGROUND OF THE INVENTION

The invention relates to a tunnel kiln especially for firing ceramic workpieces. As used herein, the term tunnel kiln is understood to mean all types of continuously operating kilns with a kiln channel or kiln chamber.

In the known tunnel kilns the material to be fired is transported through the furnace chamber by means of kiln cars, in the direction of the longitudinal axis of the kiln. The kiln cars thus pass through a heating , a firing and finally a cooling zone. The kiln cars are provided with a bottom designed like a plate, made of thermal insulating, heat-resistant material, thereby forming themselves kiln sole sections movable through the firing channel. This known construction of a kiln car is pretty strong and offers a safe protection against excessive heating of the leading means for the kiln cars. As a result, the bottom plate of each kiln car, forming respectively one kiln sole section of the firing channel, has to be moved through all zones of the kiln together with the workpieces to be fired and placed there upon. Regarding known kilns for ceramic workpieces, the relation between the net feeding weight per kiln car to the corresponding tare weight is at about 1:1.8, i.e. the weight for the workpieces to be treated is merely about 36% of that of the total mass to be heated up and cooled thereafter. As a consequence of this, high expenditure of energy is necessary and because of the necessity to heat and to cool a considerable tare mass together with the workpieces to be treated a substantial inertia during the heating and cooling process is caused with considerable limitations of the passage of carriage through said tunnel kilns. In case the known tunnel kilns of said type are provided with recuperators in the cooling zone, the heat transmission from the bottom plates of the kiln cars to the recuperator is more difficult and unfavourable in its effectiveness.

SUMMARY OF THE INVENTION

It is an object of the present invention to improve tunnel kilns of the known type so that under complete maintainance of its reliability in operation, the energy amount necessary for the operation of the kiln and for the treatment of the workpieces can be reduced, the inertia during the heating and cooling process can be overcome and its passage rate can be increased.

The above and other objects are achieved, according to the invention, in a tunnel kiln wherein the kiln sole sections are separated from the kiln cars and the kiln cars are movable independently of the kiln sole sections and separate parallel-going leading means are provided within the firing channel for the kiln cars and the kiln sole sections.

By this a standard operation of the tunnel kiln is enabled whereby the kiln sole sections stand still on their leading means in the kiln channel while the kiln cars are moved (guided) through the channel. The kiln sole sections standing in a certain zone of the kiln thereby have a temperature of the respective kiln zone. The kiln cars separated from said kiln sole sections have a considerably reduced tare mass compared with that of known kiln cars, thus the expenditure of energy for the operation of the tunnel kiln or rather for the treatment of the workpieces sent through that tunnel kiln, can be substantially reduced.

As the kiln sole of the firing channel always has a temperature corresponding to that of the respective kiln zone, the heating and cooling process for the workpieces to be fired becomes faster and more effective. Regarding tunnel kilns with recuperators in the cooling zone, a quick and very effective heat transmission is enabled from the hot workpieces to the recuperators, thus making the heat recovery in the cooling zone more effective.

On the other hand, the invention offers the possibility, in case of any appearing troubles, e.g. the fall of a workpiece from the kiln car onto the kiln sole section underneath, to move the kiln sole sections together with the kiln cars through the firing channel until such a disturbance has been eliminated, e.g. the kiln car concerned and the corresponding kiln sole section with the workpiece thereon have left the kiln at its exit. Thus the reliability in operation is at least as high as with known tunnel kilns.

In a preferred embodiment of the invention the kiln cars extend over the width of the firing channel, thereby traversing (like a bridge) the kiln sole sections whereby the kiln cars are guided on outer leading means and the kiln sole sections by at least one inner leading lane all provided within the firing channel. This embodiment offers on the one hand, a complete closed kiln sole formed by the kiln sole sections, and, on the other hand, a very stable construction and guidance of the kiln cars.

To further augment this embodiment of the invention, each kiln car can be principally composed of two panellike side-elements supporting beams extending across the firing channel from one side-element to the other for taking the workpieces to be fired, said beams being arranged with distance to the top side of the kiln sole sections. It has surprisingly been found that said beams are suitable to traverse the complete width of the kiln channel respectively the complete width of the kiln sole sections under all temperature conditions in the different kiln zones, without the necessity of any further support and that the kiln cars can be loaded as usual.

The kiln car side-elements can be designed like longitudinal small cars each having one kiln car sidewall extending along an opening between the kiln sole sections and the corresponding side wall of the firing channel, whereby each of said side-elements of said kiln cars is guided, stable in itself, by a leading path in the firing channel. These kiln car side elements, designed like longitudinal small cars, lead to sufficient stability, because of their own strength, even if those parts of the kiln car extending traversely over the firing channel are only laid loosely on said side-elements. An advance control and a constant safe movement of these only loosely assembled kiln cars can simply be achieved by a hydraulic advance arrangement of the known type.

The kiln car side-elements can be made, at least in their top parts, of fire-resistant, thermal insulating materials and the beams can be set upon the top part of these side-elements of the kiln cars. It is of particular advantage if the side-elements of the kiln cars end at the same level as the top side area of the kiln sole sections and to place distance holders on the side-elements with a height corresponding to the requested interspace between the kiln sole sections and the beams. The beams are then placed upon said distance holders. Thus a kiln sole area can be achieved, extending from one side wall of the firing channel to the other, being of particular advantage for the gas-circulation and flame adjustment. The distance holders supporting the beams, can be "blocklike" elements, set into corresponding recesses at the top side of the side-elements of the kiln cars, there finding safe support.

According to the invention, the supporting beams can show a hollow profile, preferably quadrate or rectangular in cross-section and consist of recrystallized silicon carbide (SiC). Such beams present a very good modulus of rupture, high maximum working temperatures and thermal shock resistance. Furthermore, such hollow profiles have the additional advantage of reduced tare masses and thus reduced heat capacity.

As according to the invention, under normal operation of the tunnel kiln, there are at least three parts movable relatively to each other and relatively to the side walls of the firing channel, in the section of the kiln sole in a preferred embodiment of the invention special and effective sealing means are provided between these parts, i.e. the kiln sole sections, the kiln car side-elements and the kiln channel side walls.

Known tunnel kilns of said type show labyrinth-like sealing elements provided at the side walls of the firing channel and at the side areas of the kiln cars, gripping into each other. Furthermore, sheets are provided at the lower edges of said side areas of the kiln cars, running into sand gutters, positioned at the side walls of the firing channel.

Regarding now the invention again, there are provided additional sealing means between the inner side-elements of the kiln cars and the side-elements of the kiln sole sections. In a preferred embodiment, the panel-like side-elements of the kiln cars and side-elements of the kiln sole sections show labyrinth-like elements engaged in each other. Furthermore, sand gutters may be provided at the lower side edges of the kiln sole sections, which sand gutters extend in moving direction of the kiln cars, and sheets are provided at the lower side edges of the inner faces of said kiln car side-elements, running in said sand gutters.

In another embodiment of the invention the sealing means between the kiln sole sections and the side-elements of the various kiln car consist of sand gutters, placed just between the leading means for said kiln sole sections and each of said leading means for said kiln car side-elements and parallel to them and sheets are provided, placed at the kiln sole sections and/or the inner sides of the kiln car side-elements, running in said sand gutters.

This construction also provides a safe sealing, so that any entering of hot gases under the kiln sole sections as well as under the kiln car side-elements, i.e. in the region where the leading means are placed, is impossible.

The last mentioned embodiment provides fixed sand gutters which offer the advantage that any gaps between different sections of the sand gutters can be eliminated through which sand or hot gases could escape.

The invention also provides means for checking the beams (supporting beams) in order to detect any flaws in the material and to replace those parts immediately. Therefore a testing apparatus may be provided, preferably outside the kiln channel and along that feed back lane for the kiln cars. This testing apparatus may comprise an ultrasonic transmitter, directed to said beams to be tested, and an ultrasonic receiver, receiving any signals transmitted by said beams. The testing procedure can be achieved while the kiln cars are passing the testing apparatus.

DESCRIPTION OF THE PREFERRED EMBODIMENTS

Figure 1:
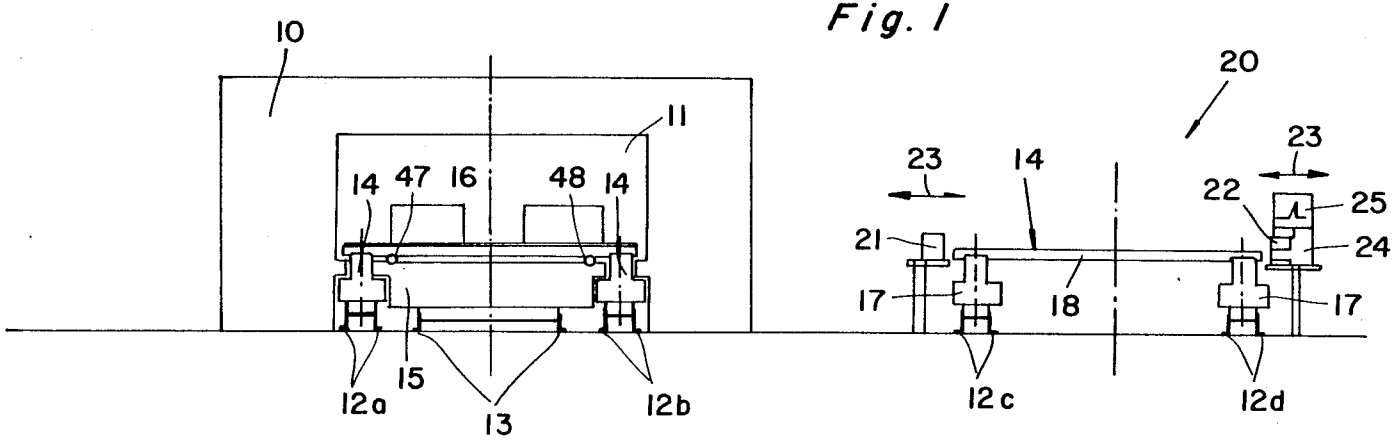
FIG. 1 is a front view showing the basic components of one preferred embodiment of a tunnel kiln accordding to the invention with a testing apparatus for the supporting beams next to it.
Figure 2:
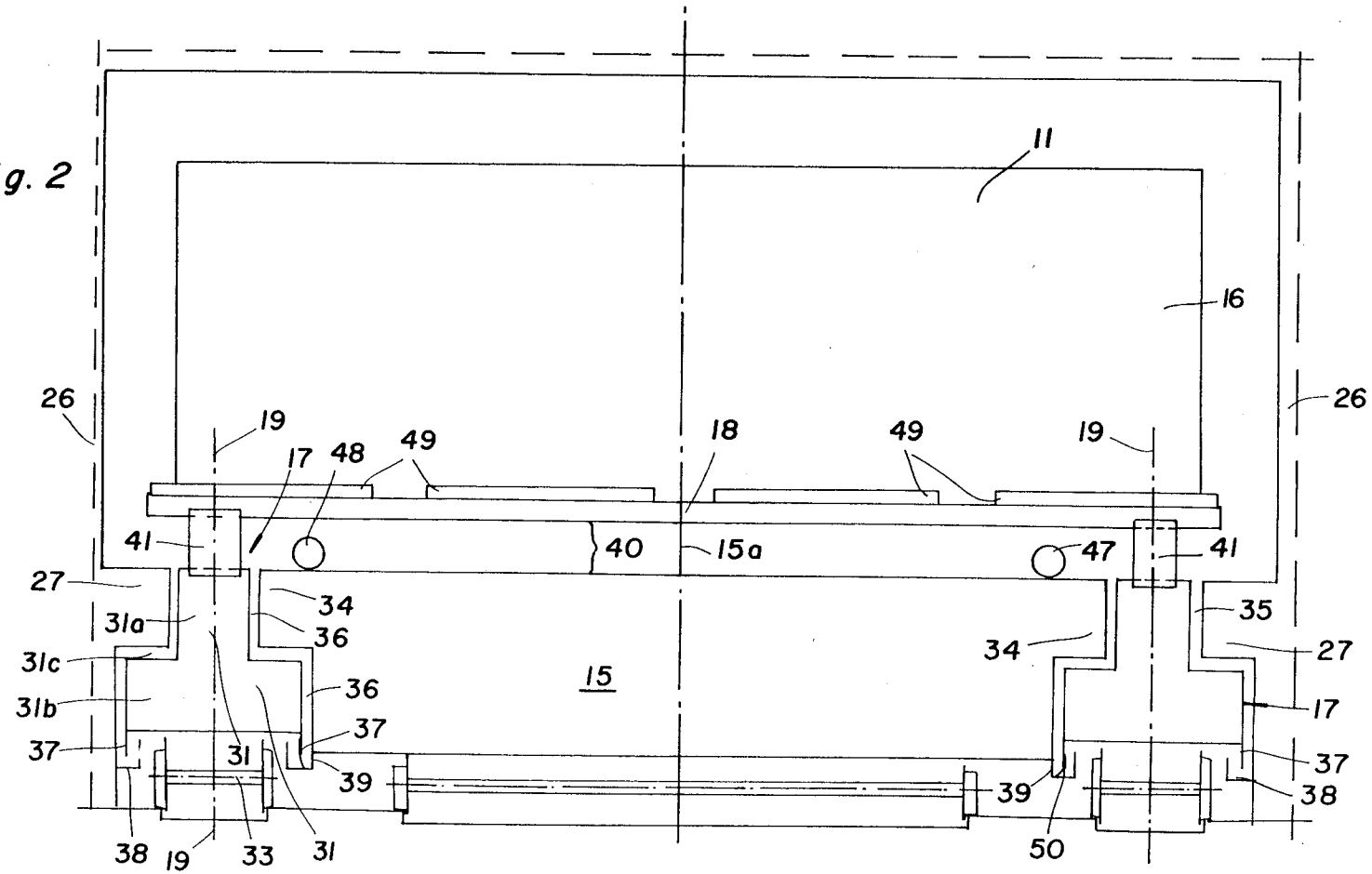
FIG. 2 is a schematic cross-section through the kiln of FIG. 1.

The tunnel kiln 10 shown in FIGS. 1 and 2, shows on the bottom of its firing channel 11 three leading ways, namely a left leading way 12*a*, a right leading way 12*b* and a leading way 13 in the middle thereof. Each of said leading ways can be constructed as leading tracks. While the outer left and right leading ways 12*a* and 12*b* are relatively small, the middle leading way 13 may be constructed as wide tracks. Within the middle leading way 13, for example between the rails, forming the track, a walk-in channel (not shown) may be arranged in known manner. The outer leading ways 12*a*, 12*b* serve for guiding the kiln cars 14 while the middle leading way 13 serves to guide the kiln sole sections 15. By this arrangement the kiln cars 14 may be moved independently of the kiln sole sections 15 through the firing (kiln) channel 11. Particularly the kiln sole sections 15 may be kept still within the firing channel 11, while just the kiln cars 14 are guided through it. As a consequence of this, the tunnel kiln following the invention is characterized by a kiln sole, mostly still standing, above which parts of the kiln cars 14 with the workpieces to be treated thereupon are moved through the different zones of the kiln. By this, only the very few parts of the kiln cars 14 and the workpieces 16 to be fired are submitted to the different temperature conditions and further treating conditions in the different zones of the tunnel kiln, while the stillstanding kiln sole sections 15 may adapt the temperature and further treating conditions for the workpieces 16 at a certain place along the kiln channel. As the lower parts of the kiln cars 14 and the leading ways 12*a*, 12*b* and 13 are covered by the kiln sole sections 15 and the kiln car side-elements 17 constant average temperatures are achieved. In any case these parts are protected against high temperatures.

In the right part of FIG. 1, a testing station 20 with a kiln car 14 therein is shown schematically. The kiln car 14 consists, following this embodiment, mainly of two side-elements 17, each of which is movable stable in itself. On top of these kiln car side-elements 17 supporting beams 18 are arranged, spaced to each other, forming together with the kiln care side-elements 17 a bridgelike construction, embracing—as shown in the left part of FIG. 1—the kiln sole sections 15.

With regard to the testing apparatus 20 on both sides of the feeding back lanes 12*c* and 12*d* installation elements 21 and 22 are arranged, one of them being movable as shown by arrows 23, while the other is disposable at the front area of beam 18. A combined ultrasonic transmitter/receiver 24 is added to the installation element 22, which is placed together with the element 22 at the front area of beam 18. Furthermore an indication (recording) instrument, e.g. some kind of oscillograph is combined with this element 22.

The kiln car 14 being on its way from the kiln channel exit back to the kiln channel entry is guided on its feed back rails 12*c* and 12*d* through the testing apparatus 12 is such a way, that the beams 18 are transported one after the other between the elements 21 and 22 and thereby in front of the ultrasonic transmitter/receiver 24. As soon as one beam 18 has been forwarded to this place the stopping elements 21 and 22 are moved towards the front faces of that beam 18, then an ultrasonic impulse is transmitted from one of said front areas through said beam 18 and the so reflected ultrasonic impulse is received by the receiver arrangement of part 24. This reflected impulse is recorded (indicated) by the recording instrument 25.

If a so tested beam is okay, a single pure peak is recorded on said instrument 25, describing the ultrasonic impulse reflected by the second front face. If there are any cracks in such a tested beam, then there are further echo signals causing additional peaks on said instrument 25.

After the testing procedure has been terminated, the stopping elements 21 and 22 are drawn back again from the front faces of the tested beam 18.

Beams 18 with cracks or the like are taken off and replaced and new beams 18, which may be also submitted at once to the above-described testing procedure.

After all of that beams 18 of that kiln car 14 have been tested, the kiln car 14 is moved on its feed back rails 12*c* and 12*d* to a loading station and from there to the entry of the kiln channel.

The kiln car side elements 17 are mainly constructed by a side wall extending over the whole length of the kiln car 14 and a truck (bogie) 33. The kiln cars 14, following each other within the kiln channel 10 are thus pushed against each other by the front faces of their side walls thereby forming two practically continuously over the whole length of the firing channel 11 extending side walls moving via the trucks (bogies) along said leading ways 12*a* and 12*b*. A transport of the kiln cars 14 through the kiln channel 11 may be achieved by a hydraulic feeding device placed at the entry of the kiln channel, feeding (pushing) one kiln car after the other in said channel entry. The uninterrupted line of kiln cars 14 ensures the feeding transmission from one kiln car to the other to the channel exit.

FIG. 2 shows that the kiln car side-elements 17 are constructed symmetrically with respect to the vertical middle plane 19 (in moving direction). As a consequence of this, each of said kiln car side elements may be placed on both sides of the kiln car 14. Furthermore the kiln sole sections 15 are designed symmetrically with respect to the vertical middle plane 15*a* in moving direction.

Figure 4:
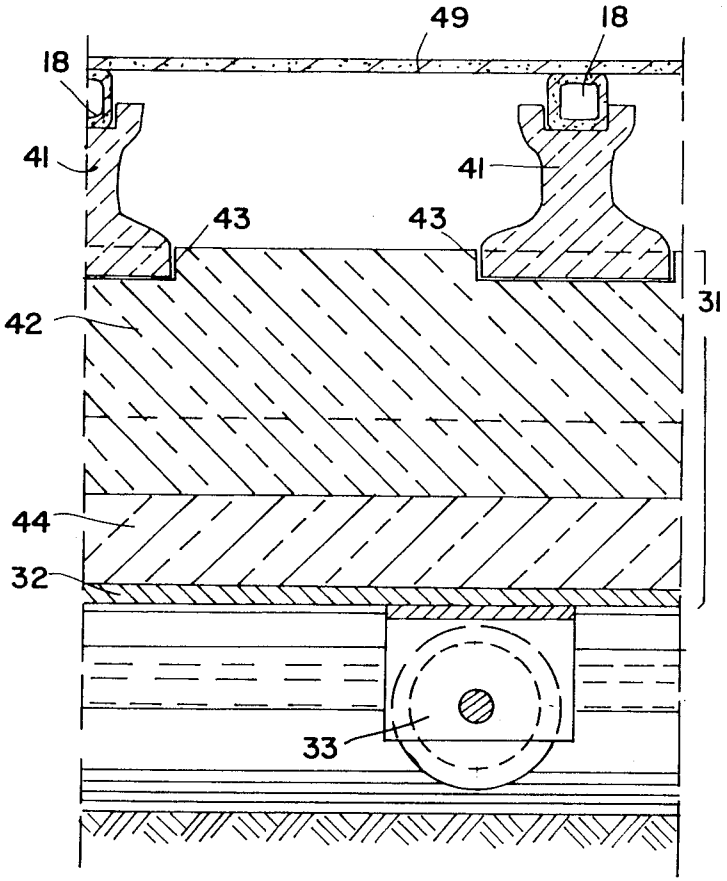
FIG. 4 is a partial schematic longitudinal cross-section through a tunnel kiln in accordance with FIG. 1.
Figure 3:
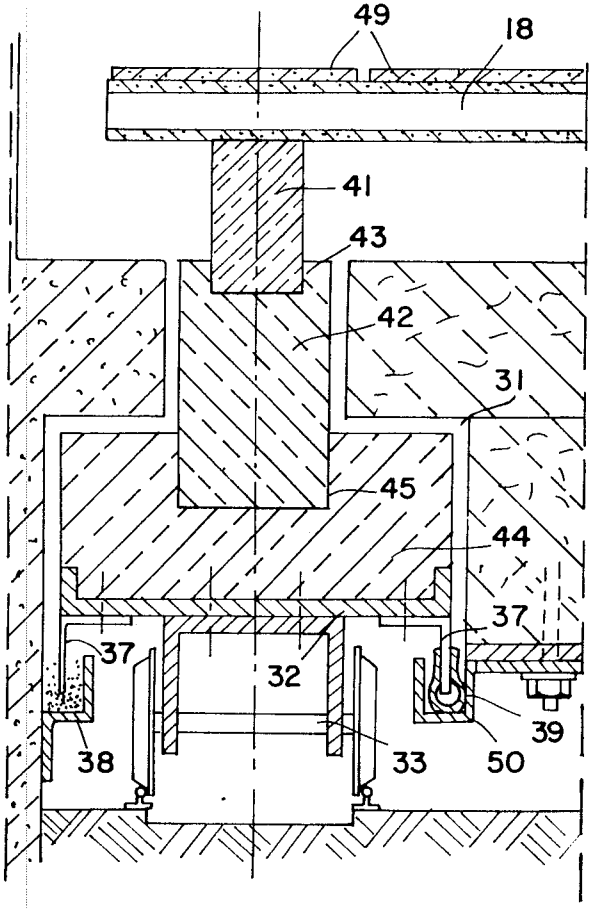
FIG. 3 a partial schematic cross-sectional view of the kiln in accordance with FIG. 2 (shown enlarged relative to FIG. 1).

FIGS. 2 to 4 show that the kiln car side-elements 17 have an uninterrupted side wall 31 over the whole length of the kiln car, being placed by means of a supporting device 32 on the truck (bogie) 33. The kiln car side wall 31 consists of an upper, small part 31*a* and a lower wider part 31*b*. The passage between these two parts is formed by two horizontal shoulders 31*c*. According to this shape of the kiln car side walls 31, the side walls 26 of the firing channel 11 are formed with sealing borders 27 and the kiln sole sections 15 are formed at their side walls with sealing borders 34, both longitudinally extending along the firing channel. By this arrangement, a gap 35 is formed between one side area of that one kiln car side wall 31 and its corresponding kiln channel side wall 26. Between the other side area of the side wall 31 and the corresponding side area of the kiln sole section 15 a corresponding gap 36 is formed, both gaps 35 and 36 are designed like labyrinthine sealing means. Further sealing of these gaps 35 and 36 is achieved by sheets 37, mounted at the underedges of each side area of the kiln car side elements 31. Each outer sheet 37 ends with its lower edge in a corresponding sand gutter 38, mounted at the lower part of the firing channel side wall 26, while each of the inner sheets 37 runs in a corresponding sand gutter 39 mounted at the lower edges of the corresponding side areas of the kiln sole sections 15. Both of the sand gutters 38, 39 extend to just below the larger lower part 31*b* of the kiln car side walls 31, while the sheets 37 mainly extend vertically downwards.

In another embodiment the sand gutter is mounted fixedly between the leading ways 12*a* and 13 and between the leading ways 12*b* and 13. The sand gutter then is constructed with an appropriate width, so that two parallel guided sheets may be guided in it, mainly the sheet 37 mounted at the kiln car side wall 31 and the sheet 37, mounted at the underedge of the side area of a kiln sole section 15.

As shown in FIGS. 2 to 4 the kiln car side elements 17 with respect to the kiln car side walls 31 end with their upper part in the same height as the upper surface of the kiln sole sections 15.

The interspace 40 between said upper surface of the kiln sole section 15 and the supporting beams 18 is realized by blocklike distance holders 41, set on top of the kiln car side walls 31.

As shown in FIGS. 3 and 4, a kiln car side wall 31 is constructed of several wall elements, extending over the whole length of the kiln car. These wall elements include an upper wall element 42, holding the blocklike distance holders 41 in corresponding recesses 43, and a lower wall element 44, itself holding the upper wall element 42 in a longitudinal groove (slot) 45. The lower wall element 44 is fixed on a frame 32, made of steel or similar resistant metal, which frame 32 is in engagement with the truck (bogie) 33. Both of the sheets 37 are fixed at said frame 32.

The upper wall element 42 is made of a heat-resistant and heat insulating material, preferably a ceramic material. The lower wall element 44 is made of a material which is characterized mostly by its mechanical strength and load carrying capacity.

The blocklike distance holders 41 present on their upper faces horizontal grooves 46, extending perpendicular to the moving direction of the kiln cars through the firing channel and serving to insert the beams 18. The beams 18 are made of recrystallized silicon carbide (SiC). As shown in FIG. 2, each of said beams 18 has a length essentially corresponding to the width of the firing channel 11. As shown in FIG. 4, the beams 18 are constructed as a hollow body with a quadrate or generally rectangular crosssection. The size of this tubular profile depends on the span between two corresponding kiln car side elements 17. Typically the beams 18 may have a length of 2.4 meters, a cross-section of $5\times50$ mm and a wall thickness of approximately 6 mm.

As shown in FIGS. 2 to 4, plates 49 are set on top of the beams 18 on which the workpieces to be treated are set. The arrangement of these plates 49 may be achieved in known manner and will be dependent of the workpieces to be fired. For example the plates 49 form a closed table. They may also be arranged with space to each other and holes may be provided in each of said plates.

As shown in FIG. 3, the sheets 37, mounted on that side of the kiln car side-elements 17 opposite to the kiln sole sections 15 are covered by a sealing strip of temperature-resistant synthetic material like a plastic material, dragging along the sand gutter 39. These sealing strips 50 may consist of a plastic fabric, dragging along the bottom of the sand gutter 39.

As shown in FIG. 4, the distance holders 41, supporting the beams 18, are constructed with a reduced middle part to save tare mass to be heated up.

We claim:

1. A tunnel kiln particularly adapted for firing ceramic workpieces with a firing channel including a heating zone, a firing zone, and a cooling zone, wherein a plurality of kiln car means bearing the workpieces to be treated are movable through said firing channel, the improvement wherein:

each of said kiln car means comprises a kiln car sole section extending along the bottom of the firing channel, and a kiln car carrying device extending along the bottom of the firing channel and constructed and arranged for carrying the workpieces to be treated.

and including first running leading means extending along the length of the firing channel below said kiln car sole sections for guiding said kiln car sole sections for movement through the firing channel, and second running leading means extending along the length of the firing channel below said kiln car carrying devices for guiding said kiln car carrying devices for movement through the firing channel, said first and second running leading means being separate from one another and parallel to one another so that said kiln car carrying devices are movable through the firing channel independently of said kiln car sole sections.

2. A kiln as defined in claim 1 wherein said second running leading means includes a pair of spaced apart outer leading lanes, and said first running leading means includes at least one inner leading lane located in between said outer leading lanes, each of said kiln car carrying devices including a pair of spaced apart kiln car transport elements each of which is constructed and arranged to be transported on one of said outer leading lanes, and a bridging means extending between said transport elements and constructed and arranged to traverse like a bridge said kiln sole sections, said kiln car sole sections being constructed and arranged to be transported on said inner leading lane.

3. A kiln as defined in claim 2 wherein each of said kiln car transport elements comprises a panel-like side-element, and said bridging means comprises supporting beams for the workpieces to be treated extending from one transport element to the other transversely across the firing channel and at a distance spaced above the top of the kiln car sole sections.

4. A kiln as defined in claim 3, wherein said side-elements are designed like longitudinal small cars each having a kiln car side wall extending along an opening between said kiln car sole sections and the corresponding side wall of the kiln channel whereby each of said side-elements is transported stable in itself by an outer leading lane in the firing channel.

5. A kiln according to claim 3, wherein said side-elements, at least in their upper part, are made of heat insulating refractories and said beams are set on the upper part of said side-elements.

6. A kiln according to claim 5, wherein said side-elements end at their upper side at the same level as the upper surface of said kiln car sole sections, said side-elements supporting distance pieces with a height corresponding to the required space between said kiln car sole sections and said beams, said beams being laid on said distance pieces.

7. A kiln according to claim 6, wherein each of said beams is constructed as a hollow body preferably with a generally rectangular cross-section and consists of recrystallized silicon carbide.

8. A kiln according to claim 3 wherein said panel-like side-elements and said kiln car sole sections include sealing elements, engaged with each other like a labyrinthine packing.

9. A kiln according to claim 8, wherein sand gutters are provided at the side edges of the lower sides of the kiln car sole sections, said sand gutters extending along the moving direction, reaching up to the lower side edges of said side-elements and sheets are provided at the lower side edges of said side-elements, running in said sand gutters.

10. A kiln according to claim 8, wherein between said inner leading lane and said outer leading lanes at least one sand gutter extends parallel to said leading lanes and sheets are provided at said kiln car sole sections or said inner sides of said side-elements, running in said sand gutters.

11. A kiln as defined in claim 3, wherein said side-elements are provided at their outer faces with labyrinthine packing elements, engaging corresponding elements in said side wall of the kiln channel.

12. A kiln as defined in claim 3, wherein said side-elements are provided at the outer side thereof with sheets guided in sand gutters, placed in the lower part of said kiln channel side walls.

13. A kiln as defined in claim 3, wherein outside the kiln channel, along a feed back lane for the kiln car means, a testing apparatus for said beams is positioned, said testing apparatus comprising an ultransonic transmitter directed to said beams to be tested and an ultrasonic receiver receiving that signals transmitted by said beams.

* * * * *